US007299873B2

(12) United States Patent
Hartman et al.

(10) Patent No.: US 7,299,873 B2
(45) Date of Patent: Nov. 27, 2007

(54) METHOD FOR PUMPING FLUIDS

(75) Inventors: Michael G. Hartman, deceased, late of Kirkland, WA (US); by Elaine Hartman, legal representative, La Grande, OR (US); Eric M. Moe, Seattle, WA (US); Robert E. Breidenthal, Seattle, WA (US); Jesse Rehr, Seattle, WA (US)

(73) Assignee: Centriflow LLC, Darien, CT (US)

( * ) Notice: Subject to any disclaimer, the term of this patent is extended or adjusted under 35 U.S.C. 154(b) by 366 days.

(21) Appl. No.: 10/471,462

(22) PCT Filed: Mar. 11, 2002

(86) PCT No.: PCT/US02/07348

§ 371 (c)(1),
(2), (4) Date: Jun. 14, 2004

(87) PCT Pub. No.: WO02/072998

PCT Pub. Date: Sep. 19, 2002

(65) Prior Publication Data

US 2005/0217859 A1 Oct. 6, 2005

(51) Int. Cl.
*E21B 43/00* (2006.01)

(52) U.S. Cl. ..... 166/302; 166/62; 166/105; 417/369; 417/371

(58) Field of Classification Search ..... 166/302, 166/369, 62, 66.4, 105; 417/366, 369, 371
See application file for complete search history.

(56) References Cited

U.S. PATENT DOCUMENTS 2,697,986 A 12/1954 Meagher (Continued)

FOREIGN PATENT DOCUMENTS

GB 1541532 3/1979

(Continued)

OTHER PUBLICATIONS

Inverted Pump Systems . . . , E. B. Brookbank, ESP Workshop Adam's Mark, Houston Apr. 26-28, 2000 (12 pp.).

(Continued)

*Primary Examiner*—William P Neuder
(74) *Attorney, Agent, or Firm*—Gary C Cohn PLLC

(57) ABSTRACT

The production rate, useful life and operating efficiency of electric submergible pumping systems (ESP) is improved by operating the system so that the motor (220, 320) is cooled by two passes of production. Production fluids remove waste heat from the motor (220, 320) by passing the fluid in contact with the exterior of the motor (220, 320). The improved cooling permits the motor to be operated at a lower temperature improving life and efficiency, and/or to be operated at higher power at a similar temperature. Additionally, oversized and excess equipment is not required, further improving performance and economics for the user. In another aspect, the invention is a method of pumping fluids using a motor having vortex generators (366) on its exterior surfaces or on the interior surfaces of a surrounding shroud.

17 Claims, 5 Drawing Sheets

U.S. PATENT DOCUMENTS 3,555,319 A * 1/1971 Schaefer ..... 310/87
4,170,436 A 10/1979 Candler
4,500,254 A 2/1985 Roznieck
5,017,087 A 5/1991 Sneddon
5,068,554 A 11/1991 Mohn
5,336,070 A 8/1994 Fujiwara et al.
5,620,048 A 4/1997 Beauquin
5,951,262 A 9/1999 Hartman
6,000,915 A 12/1999 Hartman
6,155,345 A * 12/2000 Lee et al. ..... 166/105.5

FOREIGN PATENT DOCUMENTS

RU 2070992 12/1996

OTHER PUBLICATIONS

Use of a Motor Cooling By-Pass System in an Electrical Submersible . . . , E. Sison, Feb. 28, 2000 (11 pp.).
A New Generation Electric Motor for Downhole Pumping Applications, Head et al., 2000 ESP Rountable (9 pp.).

* cited by examiner

METHOD FOR PUMPING FLUIDS

The present invention relates to methods for pumping fluids, primarily from wells.

Water, oil and natural gas are commonly produced in wells. The wells are formed by drilling a hole into a rock formation to the depth where the fluid reservoir lies. A well casing is inserted into the hole following the drilling. If natural gas is present in the well, it is readily recovered from the well due to its natural buoyancy, while in most cases water and oil must be pumped to the surface.

Various types of pumping systems are used to produce fluids from wells. Among these are sucker-rod/beam systems, plunger lift systems, continuous or intermittent gas lift systems, hydraulic reciprocating pumps, progressive cavity pumps and electrical submergible pumps (ESPs). An ESP includes an electric motor that drives a submergible pump that forces fluids from the reservoir to the surface.

ESPs are often remotely operated in wells commonly at great depths, in harsh environmental conditions. A challenge in using ESPs is effective heat removal. Resistance in the electric motor windings generates a significant amount of waste heat in operation, as do mechanical friction and fluid friction. If this waste heat is not sufficiently removed, the motor temperature can rise significantly. Increasing the motor temperature leads to a number of problems. Motor life becomes considerably shorter as temperatures increase. Motor winding insulation, bearings, seals, and lubrication are all adversely affected by high temperature. As a result, ESPs commonly are removed from wells more often than desired in order to replace or repair the electric motor. In the oil market in particular, this results in high maintenance and repair costs as well as significant losses of revenue due to lost production. Alternatively, to keep motor temperatures within reasonable limits, sometimes the production is reduced to a rate lower than desired, equipment is oversized or excess equipment is used, compromising the efficiency and profitability of the well. Electrical efficiency also tends to decrease as the temperature rises and additional horsepower is necessary when excess equipment, like gas separators or additional seals, are used. This results in increased energy costs, as more electrical power is needed to perform a given amount of work.

Sometimes this problem is exacerbated because of particular well conditions or operator choices. Well conditions such as high gas content, high viscosity production fluids, the formation of emulsions, low flow rates, multiphase flows, steam flood production, deviated and horizontal wells, increasing well depth and other factors can contribute to high motor temperatures. Some of these conditions make it difficult for a well operator to properly size and operate an ESP.

The production fluid is often used to remove some of the waste heat and provide some temperature control. In conventional ESP installations, production fluids are drawn or pumped past the motor and remove some heat. This effect is illustrated in FIGS. 1 and 1A, which represent conventional ESP and so-called "inverted ESP" pumping systems. In FIG. 1, well 1 has casing 2 that has perforations 7 through which production fluids enter the well. The ESP system includes pump 3, motor 4 and seal section 5. Production fluids enter the well at a point below or near the bottom of motor 4, pass by motor 4 in the direction indicated by arrows 8, and then enter pump 3 at pump intake 6. The production fluids are forced upwardly by pump 3, exiting at the top of pump 3 and traveling to the surface in the direction indicated by arrow 9. Cable 10 provides electrical power to motor 4 from the surface. As shown, a packer 16 may be used in the assembly.

In the "inverted ESP" system shown in FIG. 1A, the relative positions of the pump and motor are reversed. Well 11 has casing 12 and perforations 17 as before. Production fluids enter pump intake 22 in the direction indicated by arrow 18. The production fluids are pumped upwardly through pump 13, exiting from outlet 21 and then flowing upwardly past seal section 15 and motor 14 in the direction indicated by arrow 19. As before, cable 20 provides electrical power from the surface. A packer 16 is again illustrated in this assemblage.

In the systems shown in FIGS. 1 and 1A, the production fluids remove some heat as they flow past the motor. However, the amount of heat that is removed is often insufficient to optimize motor performance and life. As a result, well operators have attempted in various ways to improve motor performance and life. One way of accomplishing this is to use special high temperature windings in the motor so that it can better tolerate higher temperatures. Unfortunately, this does nothing to reduce heat in the bearings, seals, and lubrication, and significantly increases the cost of the motor. Additionally, running at higher temperatures makes the equipment more prone to scale and corrosion and lowers electrical efficiency. Another technique is to add a shroud around the motor to increase the fluid velocity. Except in installations where fluid does not flow across the motor housing, shrouds will not significantly change the character of the flow (laminar or turbulent), are expensive and can be difficult or impossible to install in deviated and slim-hole wells.

Another attempt to improve production using ESPs is described in "Operating Electric Submersible Pumps Below Perforations, J. of Petrol. Techn., p. 742 (July 1997) and by Sison in "Use of A Motor Cooling By-Pass System in An Electric Submersible Pump to Increase the Economic Life of Gas Wells", Feb. 28, 2000. In these methods, an ESP system is installed in the well below the perforations. Production fluids enter the well and the pump intake without passing in fluid contact with the motor. Without convective cooling, a portion of the production fluids must be drawn off from the pump and recirculated down to the base of the motor and released to remove heat. This typically requires that a second, recirculation pump be used together with special recirculation tubing, and thus is complex, expensive and less efficient than desired. It is also difficult to effectively recirculate enough fluid to provide adequate heat removal. Another approach is the so-called Framco ESP system, which also involves circulating a cooling fluid through the motor from the wellhead. This is described in "The Framco ESP System: A New Approach to Downhole Electric Submersible Pumping", presented by Jon A. Svaeren and Frank Mohn at the ESP Workshop, Houston, Tex., Apr. 30-May 2, 1990. Again, the complexity and expense of such a system makes it undesirable.

Another approach is described in U.S. Pat. Nos. 5,951,262 and 6,000,915 to Hartman. The Hartman patents describe a pump motor having a hollow rotor shaft that can drive a separate pumping unit. The pumping unit is in fluid communication with the hollow rotor shaft, so that production fluids are pumped through the hollow rotor shaft of the motor, thereby providing cooling to the interior of the motor and allowing it to operate more efficiently.

Thus, an improved ESP system would be highly desirable, particularly one which enables more effective and efficient heat removal from the electrical motor particularly if this can be achieved without the expense of additional components or unnecessary features.

A further concern in many wells is the separation of liquids and gasses. This problem is often seen in wells that produce both natural gas and oil. Pumping a gas/liquid mixture creates inefficiencies that can be avoided if the gasses and liquids can be separated easily before the liquids enter the pump intakes. It would be desirable to provide a method by which gaseous and liquid fluids can be easily and inexpensively separated before the liquids enter a pumping system.

In a first aspect, this invention is method of pumping a fluid with a submergible pumping system including a pump and an electrical motor, wherein the electrical motor has a hollow rotor shaft and said pumping system is adapted to pump at least a portion of said fluid through said hollow rotor shaft, and wherein at least a portion of said fluid passes in fluid contact with exterior portions of the electrical motor and remove heat from the electrical motor.

In a second aspect, this invention is a method of pumping fluids with a submergible pumping system including a pump and an electrical motor, wherein (a) the electrical motor has a hollow rotor shaft and said pumping system is adapted to pump said fluid through said hollow rotor shaft, and (b) the pumping system is submerged in said fluid such that production fluids entering the pumping system pass in fluid contact with exterior portions of the electrical motor and remove heat therefrom before entering the production fluid intakes, and said production fluids then pass through the hollow rotor shaft of the electrical motor as the fluid is pumped, and remove additional heat from the motor.

In a third aspect, this invention is a method for pumping fluids from a well having a casing that contains perforations through which production fluids enter the well, comprising (a) positioning an electrical submergible pumping system including an electric motor within said casing such that the electric motor is at or below at least some of said perforations, and (b) pumping production fluids from the well with said pumping system, wherein (i) the pumping system includes a pump, an electrical motor having a hollow rotor shaft and production fluid intakes located below said electrical motor, said pumping system being adapted to pump said production fluids through said hollow rotor shaft of the electrical motor, (ii) liquid production fluids entering the well through at least some of the perforations in the well casing come into fluid contact with exterior portions of the electrical motor and remove heat therefrom before entering the production fluid intakes, and (iii) liquid production fluids pass through the hollow rotor shaft of the electrical motor as the fluid travels toward the wellhead, and remove additional heat from the motor.

In a fourth aspect, this invention is a method comprising pumping a fluid with a submergible pumping system including a pump and an electrical motor, wherein (a) the electrical motor has a hollow rotor shaft and the pumping system has a fluid intake below the electrical motor in liquid communication with said hollow rotor shaft;

(b) the pumping system has at least one outlet located at or below the electrical motor, said outlet being in liquid communication with the fluid intake;

(c) the pumping system is submerged in a well having a well casing;

(d) the cross-section of the electrical motor is such that the electrical motor fits within the well casing and a space is defined between the well casing and exterior of the electrical motor; and said pumping system is adapted so that during operation a portion of the fluid entering the fluid intake is pumped through the hollow rotor shaft, and a portion of the fluid entering the fluid intake is pumped through the outlet and upwardly in fluid contact with the of outside of the electrical motor in the space defined between the well casing and the exterior of the electrical motor.

In a fifth aspect, this invention is a method of pumping a fluid from a well having a wellhead and a well casing, using a submergible pumping system including a pump and an electrical motor, comprising (I) positioning a pumping system in a well with the pump being located between the electrical motor and the wellhead; wherein (a) electrical motor has a hollow rotor shaft which is in liquid communication with the pump, (b) the cross-section of the electrical motor is such that the electrical motor fits within the well casing and a space is defined between the well casing and the electrical motor;

(c) the pumping system has a first fluid intake in liquid communication with said hollow rotor shaft;

(d) the pumping system has a second fluid intake above the motor in liquid communication with the space defined between the well casing and the electrical motor, with the at least one outlet located at or below the electrical motor, said outlet being in liquid communication with the fluid intake; and (II) operating said pumping system under conditions such that during operation a portion of the fluids enter said first fluid intake and is pumped through the hollow rotor shaft of the electrical motor, and a second portion of the fluids are pumped through the space defined between the well casing and the electrical motor and in fluid contact with the exterior of the electrical motor to enter the second fluid intake, and said first and second portions of the fluids are then pumped to the wellhead.

The methods of these aspects of the invention provide several significant benefits. Production fluids in laminar or turbulent flow that come into fluid contact with the exterior of the electrical motor provide heat removal. In gassy wells, the increased flow rate made possible by operating the ESP below the perforations may foster turbulent flow in the annulus between the motor housing and the well casing, contributing to a significant increase in heat transfer. An additional cooling effect is seen when the production fluids pass through the hollow rotor shaft; thus, the production fluids are used to remove heat twice in this invention, once as they pass outside of the motor and a second time as they pass through hollow rotor shaft. The combined cooling effects help maintain the motor within optimal or desired temperature limits. This prolongs motor life and reduces maintenance costs and other expenses attributable to premature motor failure. It also allows an operator to increase the production by increasing the horsepower capability of existing equipment without raising the temperature. The cooling effect can be further facilitated if the pump and/or hollow rotor shaft is designed so that the production fluids experience turbulent flow as they pass through the hollow rotor shaft. The combined cooling effect of the well fluids passing the outside of the motor and through the hollow rotor shaft of the motor provides advantages such as prolonged motor life, increased horsepower density and/or greater electrical efficiency. It often provides combinations of these benefits.

Surprisingly, these benefits are achieved despite the fact that the production fluids are forced through a reduced diameter area as they pass through the hollow rotor shaft of the motor. Additional energy is needed to accomplish this, which normally would be expected to increase operating costs and contribute to additional temperature rises. Unexpectedly, it has been found that this penalty is significantly offset by the benefits of additional heat removal that is achieved by flowing the production fluids in fluid contact with the exterior of the motor and through the motor's hollow rotor shaft.

In a sixth aspect, this invention is a method of pumping fluids with a submergible pumping system including a pump and an electrical motor, wherein the pumping system is submerged in said fluid such that production fluids entering the pumping system pass in fluid contact with exterior portions of the electrical motor and remove heat therefrom before entering the production fluid intakes, wherein the exterior portions of the electrical motor or the interior portions of a surrounding shroud include vortex generators adapted to impart streamwise vorticity to the production fluids as they pass in fluid contact with the exterior portions of the electrical motor. This aspect of the invention provides an economical means for substantially increasing the efficiency of heat removal from the motor. This aspect of the invention can be incorporated into the first and second aspects of the invention.

In a seventh aspect, this invention is a mechanism for providing motive force, the mechanism comprising (I) a power unit including:

(a) a housing having an exterior wall;

(b) a hollow rotor shaft having a longitudinal axis and opposite ends, the hollow rotor shaft being rotatably mounted within the housing for rotation of the hollow rotor shaft relative to the housing, substantially about the longitudinal axis of the hollow rotor shaft; and (c) a drive system mounted within said housing connected to the hollow rotor shaft for causing rotation of the hollow rotor shaft relative to the housing, wherein the drive system includes a plurality of magnets mounted within the housing, located around the hollow rotor shaft, wherein the magnets create magnetic forces for causing the hollow rotor shaft to rotate relative to the housing;

and (II) a pumping unit located below the power unit, wherein (i) the pumping unit includes a longitudinal hollow drive shaft that is in fluid communication with the hollow rotor shaft in the power unit, the hollow drive shaft being rotated substantially about its longitudinal axis when the hollow rotor shaft is rotated;

(ii) the hollow drive shaft has a shaft inlet proximate to its bottom portion for allowing fluids being pumped to enter the hollow drive shaft;

(iii) at least one impeller mounted to the exterior of the hollow drive shaft such that when the hollow drive shaft is rotated, the impeller mounted on the hollow drive shaft pumps fluids downwardly toward the inlet in the hollow drive shaft; and (iv) the pumping unit has fluid intakes proximate to a topmost portion of the pumping unit, through which fluids being pumped enter the pumping unit; the fluid intakes, hollow drive shaft, shaft inlet and impellers being adapted such that when the hollow drive shaft is rotated about its longitudinal axis, fluids are pumped into the pumping unit through said fluid intakes, downwardly within the pumping unit to the shaft inlet of the hollow drive shaft, and then through the hollow drive shaft of the pumping unit and through the hollow rotor shaft of the power unit.

In an eighth aspect, this invention is a method of removing a mixture of gaseous and liquid fluids from a well having at least one point where a mixture of gaseous and liquid fluids enter the well comprising (I) positioning a pumping system in the well above the point or points where the mixture of gaseous and liquid fluids enter the well, wherein:

(a) the pumping system includes at least one power unit, at least one pumping unit, and at least one intake through which fluids being pumped enter the pumping system;

(b) the power unit includes an electric motor having a hollow rotor shaft in fluid communication said intake, and the pumping system is adapted such that fluids entering the intake are pumped through the hollow rotor shaft of the power unit;

(c) the power unit and pumping unit are smaller in diameter than the well;

(d) the intake is located below at least a portion of the pumping system and is of smaller diameter than at least that portion of the pumping system above the intake;

(e) the intake is adapted such that liquid fluids being pumped by the pumping system are caused to flow downwardly through a section of the intake to enter the pumping system; and (II) operating the pumping system such that (i) the gaseous fluids and the liquid fluids separate at a point proximate to the intake and below that portion of the pumping system above the intake, (ii) the gaseous fluids bypass the pumping system and rise to the surface of the well, and (iii) the liquid fluids being pumped flow upwardly to the intake, then downwardly through a section of the intake and then through the hollow rotor shaft of the motor and subsequently out of the well.

Figure 1:
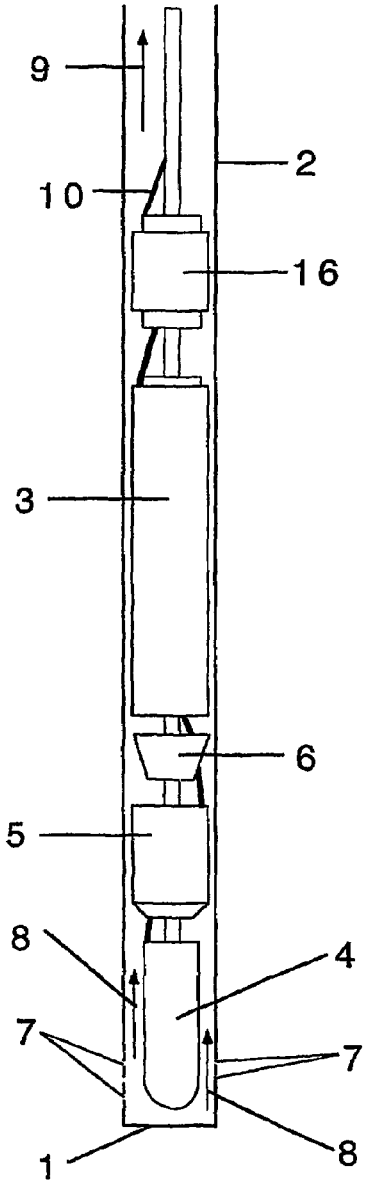
FIG. 1 (PRIOR ART)
FIG. 1 is a schematic view of two conventional ESP systems.
Figure 1A:
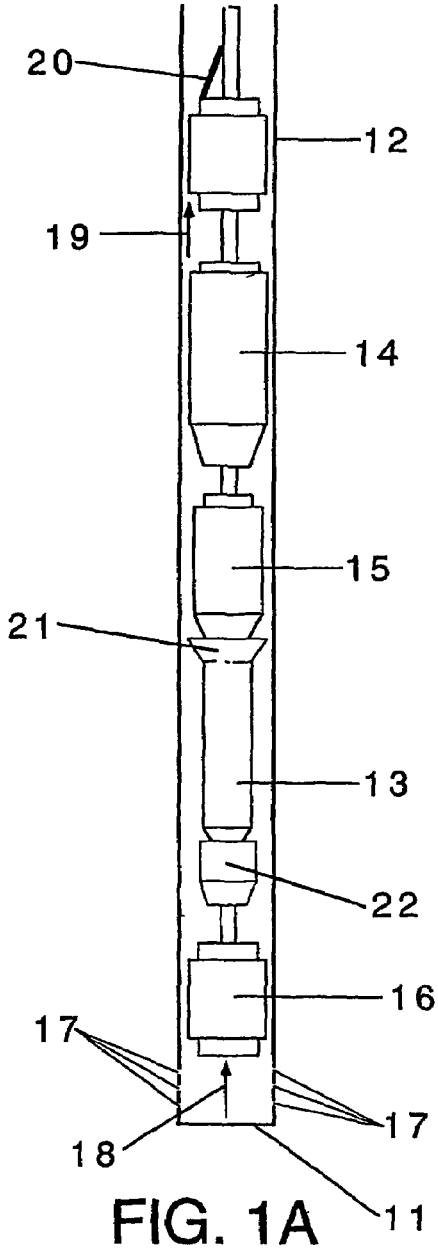
FIG. 1A (PRIOR ART)

In this invention, a submergible pumping system is used to pump a fluid. The system includes a pump and an electrical motor. The electrical motor has a hollow rotor shaft and said pumping system is adapted to pump said fluid through said hollow rotor shaft. External cooling is also provided by the production fluids. In some embodiments, the pumping system is submerged in the fluid such that production fluids entering the pumping system pass exterior portions of the electrical motor and remove heat therefrom before entering the production fluid intakes, and said production fluids then pass through the hollow rotor shaft of the electrical motor as the fluid is pumped, and remove additional heat from the motor. The conditions of the fluid flow are preferably such that the fluid flow is turbulent, has streamwise vortices, or both as the fluid passes the exterior portions of the electrical motor, and is turbulent as it passes through the hollow rotor shaft. In other embodiments, the production fluids are split as they are pumped, with some being pumped through a hollow rotor shaft and the remainder being pumped past the exterior surface of the motor.

Typically, the pumping system is installed in a well, or else has a mechanical means for inducing the fluid to pass in fluid contact with exterior portions of the electrical motor. An example of such a mechanical means is a shroud which partially covers the pumping system, and has an opening to the fluid being pumped at the opposite end of the pumping system from where the production fluid intakes are located. This shroud permits the fluids to pass in fluid contact with the exterior portions of the electric motor and enter the production fluid intakes. The spacing between the shroud and the exterior portions of the electrical motor is preferably such that the fluids exhibit turbulent flow as they pass in fluid contact with the exterior of the motor and do not impair installation in the well or create excessive head loss. Alternatively, or in addition, vortex generators impart streamwise vortices to the production fluids as they flow through the spacing between the shroud and the exterior portions of the electrical motor.

In preferred embodiments of the invention, the pumping system is installed in a well. The well may be vertical, horizontal, or a so-called "divert" type. The well has a casing that has perforations through which production fluids enter the well. The pumping system includes an electrical motor having a hollow rotor shaft. The pumping system has production fluid intakes through which the production fluids enter. These are located below said electrical motor (in the case of a horizontal well, opposite from the wellhead). The pumping system is adapted to pump said production fluids through the hollow rotor shaft of the electrical motor and then on to the wellhead.

By "production fluids", it is meant any fluids which are desired to be withdrawn from the well. Examples of such fluids include water, oil, natural gas, and the like, with liquids being of particular interest and oil being of special interest.

By "perforations", it is merely meant openings in a well casing through which the production fluids enter the well. No particular configuration or method of forming these openings is critical to the invention. The pumping system is located below at least some of the perforations in the casing. Thus, production fluids entering those perforations that are above the pumping system flow in fluid contact past the exterior portions of the electrical motor and into the production fluid intakes, by force of gravity and/or the action of the pumping system. In general, the pumping system should be below enough of the perforations that sufficient production fluids pass the exterior of the electrical motor to provide a cooling effect. Preferably, at least half of the production fluids will pass by the exterior of the motor before entering the production fluid intakes. More preferably, the pumping system is below substantially all of the perforations, and substantially the entire volume of production fluids passes in fluid contact with the exterior of the motor. This tends to maximize the desired cooling effect. Having the pumping system below substantially all of the perforations also facilitates separation of gaseous and liquid production fluids before the liquids enter the pumping system. This will increase the production rate when the well produces a mixture of gasses and liquids. Having the gasses circumvent the pump avoids various associated problems such as gas-lock or pumping inefficiencies that are attributable to entrained gasses. As gasses have lower heat capacities than liquids, having the gasses circumvent the motor in this manner further improves heat transfer and, thus, motor cooling. Additionally, because the pumping unit does not require oversized equipment or a gas separator as are typically used in conventional systems installed above the perforations, no significant additional power is consumed.

The pumping system includes an electrical motor and a submergible pump that is driven by the electrical motor. The motor and pump may have a unitary structure (i.e., share a common housing), but it is often preferred that they are separate units which are connected together directly or indirectly as they are installed in the well.

Figure 2:
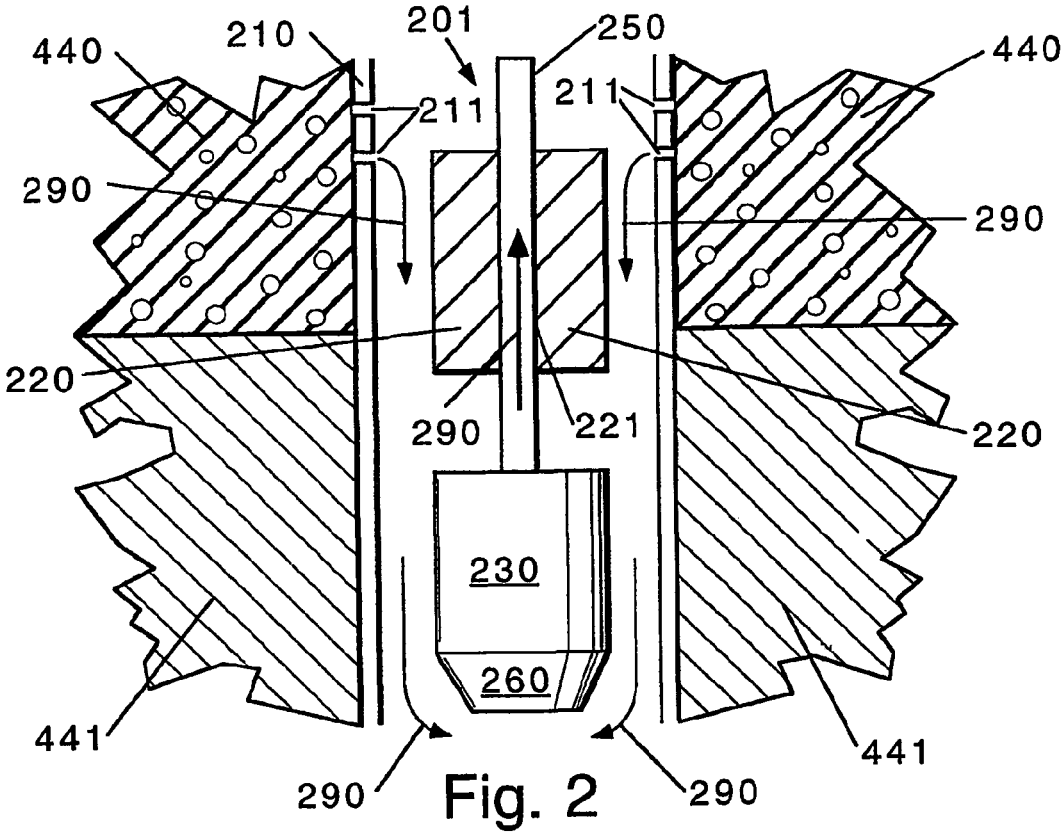
FIGS. 2 and 2A are cross-sectional views of embodiments of this invention.

Two embodiments of the process of the invention are illustrated in FIG. 2. In FIG. 2, well casing 210 extends along the periphery of well 201, which as shown has been bored through a producing subterranean rock stratum 440 and into a lower, non-producing subterranean rock stratum 441. Producing stratum 440 contains production fluids that are to be pumped to the well head. Casing 210 includes perforations 211 through which the production fluids are admitted into the well for pumping to the surface.

Located within casing 210 is a pumping system that includes motor 220 and pump 230. Both motor 220 and pump 230 are located below perforations 211. Motor 220 is affixed to production pipe 250, which is shown in section. If desired, production pipe 250 can take the form of a coiled tube. Motor 220 is shown in section to reveal hollow rotor shaft 221, which rotates when motor 220 is operated to provide motive force to operate pump 230. The production fluids pass through the hollow rotor shaft on their way to the wellhead through production pipe 250. Hollow rotor shaft 221 is mechanically connected, directly or indirectly, to pump 230 in a manner such that pump 230 is operated when hollow rotor shaft 221 is rotated. As shown, the drive shaft of pump 230 is directly connected to hollow rotor shaft 221, without intermediate apparatus. However, it may be desirable to include various types of intermediate apparatus such as a sealing section between motor 220 and pump 230. The manner through which motor 220 is affixed to production pipe 250 and pump 230 is not critical; a variety of fasteners, interlocking devices and the like can be used. Power is provided to the motor from the wellhead through a cable or similar device, which is not shown.

Intake 260 is attached to pump 230. When the pumping system is activated, hollow rotor shaft 221 rotates substantially along its longitudinal axis, driving the action of pump 230. Production fluids enter the pumping system through intake 260 and enter pump 230. Hollow rotor shaft 221 is in liquid communication with production pipe 250 and pump 230, so that fluids pumped upwardly by pump 230 pass through hollow rotor shaft 221 and then enter production pipe 250 through which they are delivered to the wellhead.

Because motor 220 is below perforations 211, production fluids that enter well 201 flow in fluid contact past the exterior of motor 220 before entering intake 260. This can be due to simple gravity, the pumping action of pump 230, or some combination of these. Arrows 290 indicate the direction of flow of the production fluids. As the production fluids must flow between well casing 210 and motor 220 as they travel toward the intake, the motor is somewhat smaller than the diameter of well casing 210, creating an annulus through which the production fluids can move. As the production fluids move in fluid contact past the exterior portion of motor 220, they remove waste heat and thus provide cooling.

Figure 2A:
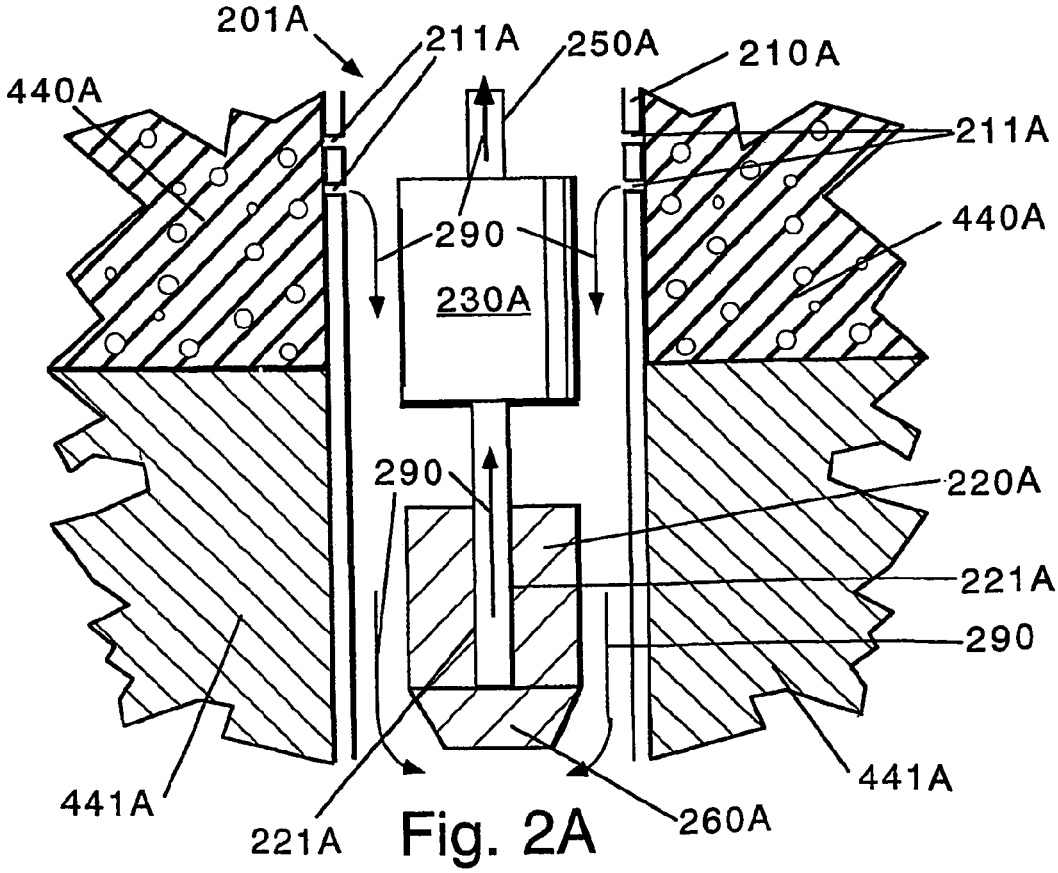

As the production fluids then are pumped through hollow rotor shaft 221 of motor 220, they remove additional waste heat and thus provide additional cooling. The embodiment of FIG. 2 is a so-called "inverted" pumping system in which the motor is above the pump. Although this is preferred to have the motor above the pump, it is not critical to the invention, and FIG. 2A illustrates an embodiment in which the motor is below the pump. In FIG. 2A, well 201A has casing 210A. The pumping system includes production pipe 250A, pump 230A, motor 220A and intake 260A. Motor 220A includes hollow rotor shaft 221A through which production fluids pass. As before, hollow rotor shaft 221A is in mechanical communication with pump 230A so that as motor 220A operates, hollow rotor shaft 221A causes pump 230A to operate and pump the production fluids through hollow rotor shaft 221A and then into production pipe 250A and up to the wellhead. In the embodiment shown in FIG. 2A, production fluids enter the well through perforations 211A, travel past the exterior of motor 220A, enter intake 260A, travel upwardly through hollow rotor shaft 221A and into pump 230A and then through production pipe 250A to the wellhead. Motor 220A is cooled twice by the production fluids; once as they pass in fluid contact with the exterior of motor 220A and again as they pass through hollow rotor shaft 221A in motor 220A).

Figure 4:
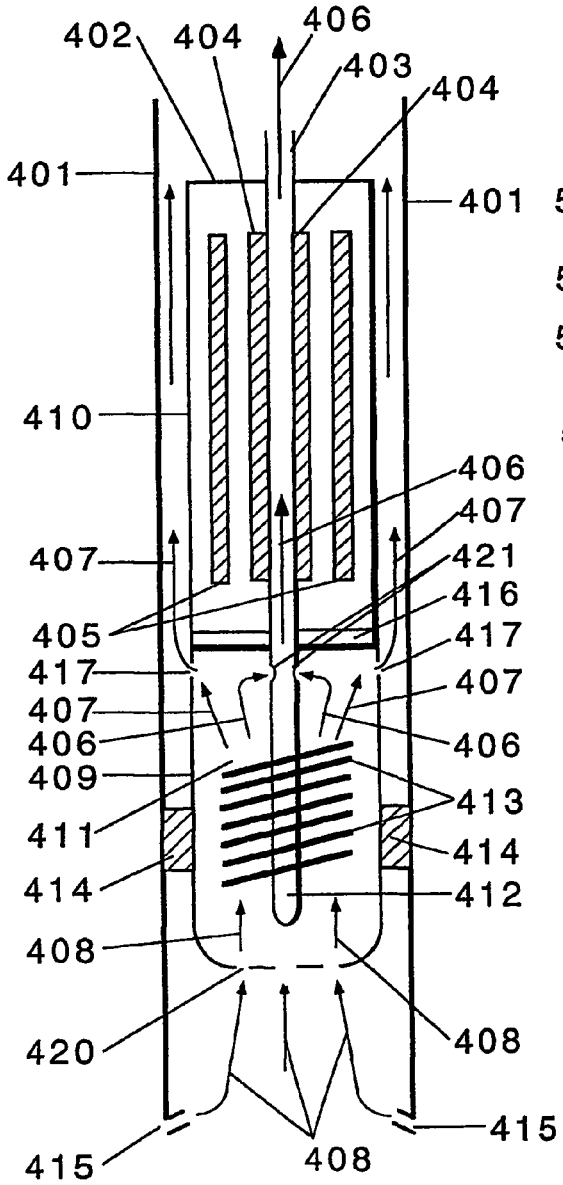
FIGS. 4-6 are cross-sectional views of embodiments of various aspects of the invention.

In FIG. 4, a pumping system including electrical motor 402 and pump 411 is located in a well having casing 401 and perforations 415. Fluid intakes 420 are located below electrical motor 402 below packer 414. In the embodiment shown, fluid intakes 420 lead directly into pump 411, which is located below electrical motor 402. However, it is possible to employ multiple pumps and multiple motors in the submergible pumping system, provided that the intakes are located below at least one electrical motor with a hollow rotor shaft.

In the preferred embodiment shown, hollow rotor shaft 403 of electrical motor 402 rotates about its longitudinal axis when electrical motor 402 is operated. This is conveniently achieved by affixing stationary magnets 404 to hollow rotor shaft 403 and supplying stators 405 to exterior housing 410 of electrical motor 402. Hollow rotor shaft 403 is coupled directly or indirectly to drive shaft 412 of pump 411, so that drive shaft 412 rotates when hollow rotor shaft 403 rotates, thereby supplying mechanical energy to pump 411. Impellers 413 are affixed to drive shaft 412 which provides motive force to impeller 413 when shaft 412 is rotated.

The embodiment shown in FIG. 4 includes optional features thrust bearing and seal 416 and packer 414. Thrust bearing and seal 416 connects electrical motor 402 with pump 411 and provides a seal against leakage of production fluids. Packer 414 assists in supporting the weight of the pumping system and prevents pressurized fluids from the pump from flowing downwardly to the pump intake. These components are well known in the art.

Intakes 420 are in fluid communication with hollow rotor shaft 403 of electrical motor 402. In the embodiment shown, fluids entering intakes 420 flow through pump 411 in the general direction indicated by arrows 408. A first portion of the fluids flow in the general direction indicated by arrows 406, entering hollow rotor shaft 403 through openings 421 and flowing upwardly through hollow rotor shaft 403 and up to the wellhead. A second portion of the fluids flow in the general direction indicated by arrows 407, passing outwardly through pump housing 409 via openings 417, and then upwardly in a space between well casing 401 and exterior housing 410 of electrical motor 402.

The embodiment shown in FIG. 4 permits the electrical motor to be cooled by the production fluids both internally (i.e., as the fluids pass through the hollow rotor shaft) and externally (i.e., as the fluids pass between the exterior of the electrical motor and the well casing), without the need to use a shroud, fluid recirculation or locate the pumping system below the perforations in the well. This avoids having to drill the well down below the perforations, i.e., no "rathole" is required to achieve the benefits of this aspect of the invention. This embodiment also permits one to avoid exposing the pumping system to sandy conditions as often exist below the perforations.

Figure 5:
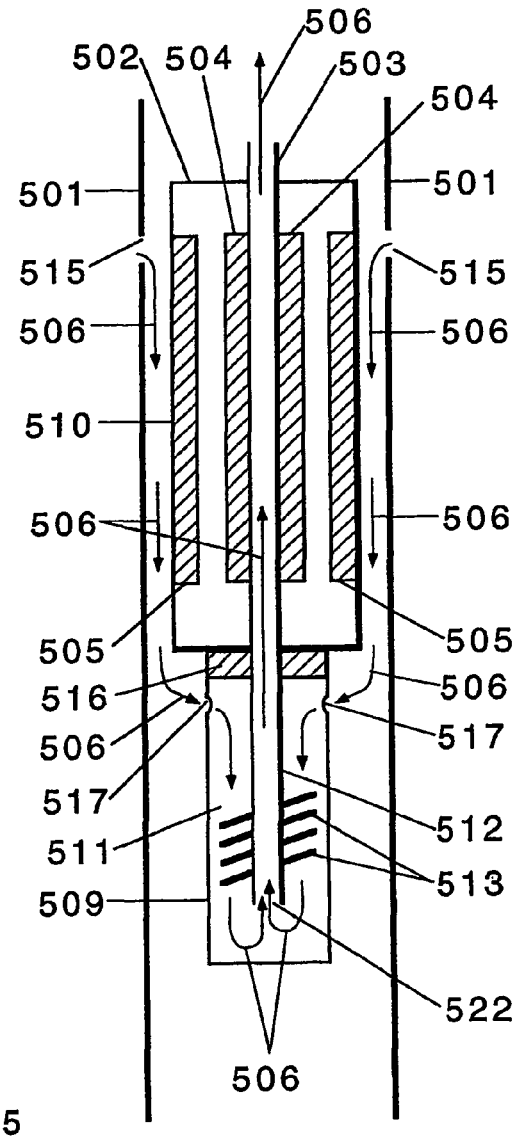

In FIG. 5, a pumping system includes electrical motor 502 and pump 511. These are located in a well having casing 601 with perforations 515. As shown, perforations 615 are located above pump intakes 517, as is preferred, but the perforations may be located at the level of or below pump intakes 517. Electrical motor 502 contains hollow rotor shaft 503. In the preferred embodiment shown, motor 502 includes a drive system including magnets 504 located about hollow rotor shaft 503 and stators 505 which are located on the interior of housing 510. When operated, hollow rotor shaft 503 rotates about its longitudinal axis.

Pump 511 includes hollow drive shaft 512 that is in fluid communication with hollow rotor shaft 503 of motor 502. When hollow rotor shaft 503 rotates about its longitudinal axis as electrical motor 502 operates, hollow drive shaft 512 of pump 511 likewise rotates about its own longitudinal axis. Hollow drive shaft 512 includes exterior (to the shaft) impellers 513 that pump the production fluids when the pumping system is operated. Hollow drive shaft 512 includes shaft inlet 522, through which fluids enter as the pumping system is operated. Pump 511 includes housing 509 having fluid intakes 517. Fluid intakes 517 are located above shaft inlet 522 and below perforations 515.

In operation, production fluids enter the well through perforations 515, flow downwardly past the exterior of electrical motor housing 510 and into intakes 517. The fluids are then pumped downwardly in pump 511 by impellers 513, where they enter shaft inlet 522 and are pumped upwardly through hollow drive shaft 512 of pump 511 and then through hollow rotor shaft 503 of motor 502, all in the direction indicated by arrows 506.

The embodiment shown in FIG. 5 includes preferred thrust bearing and seal 516. In this invention, the downward flow of the fluids through pump 511 before entering shaft inlet 522 reduces the downward force produced on pump 511. This in turn relieves the pump thrust carried by thrust bearing and seal 516, thereby prolonging its useful life and reducing the need for service and repair. In addition, this aspect of the invention permits the electrical motor to be cooled both on its exterior and its interior by the production fluids.

Figure 6:
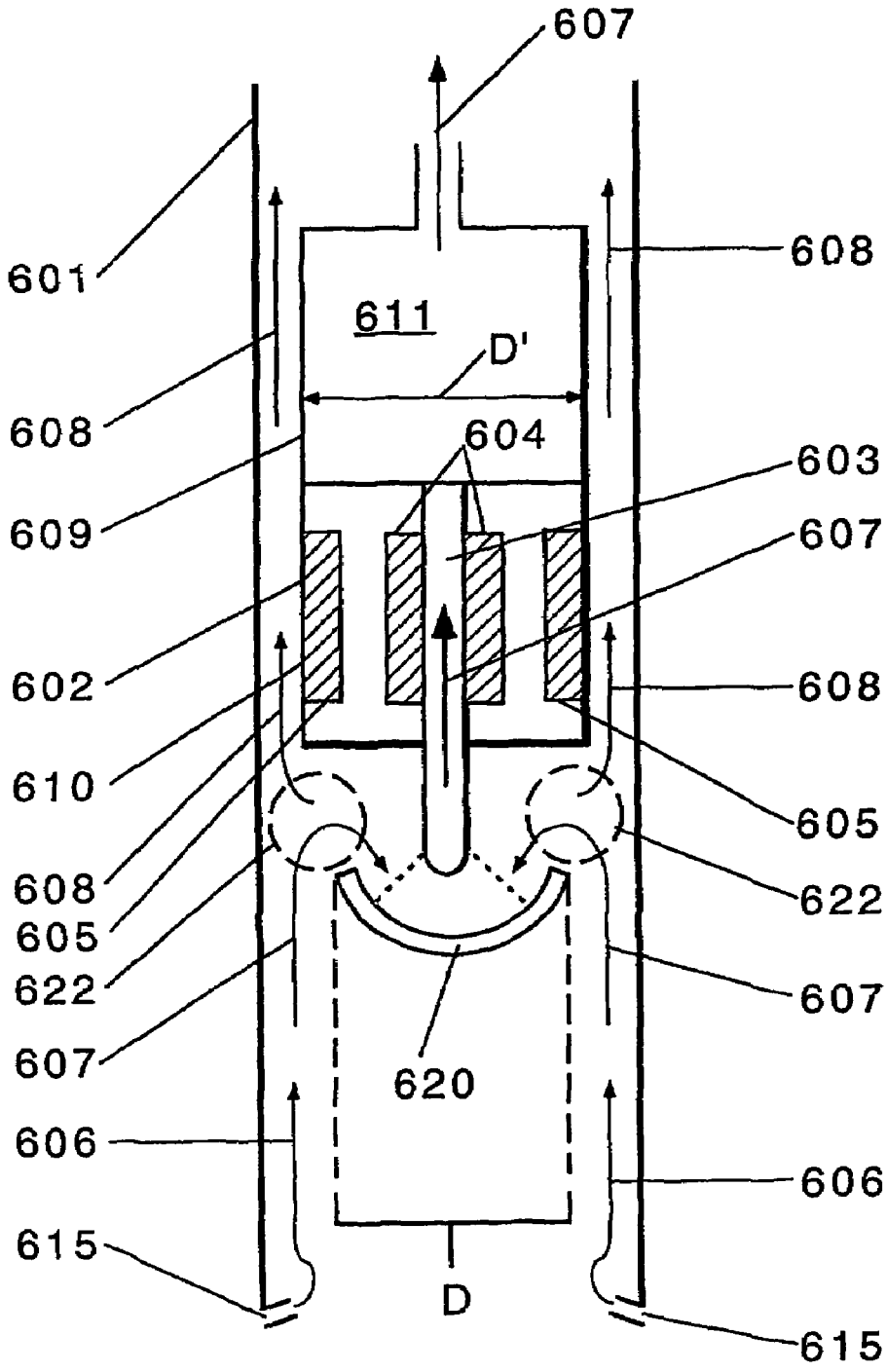

In FIG. 6, a pumping system including pump 611 and electrical motor 602 is located in a well having casing 601 with perforations 615, where production fluids enter the well. Perforations 615 are located below the pumping system. The production fluids are a mixture of at least one liquid and at least one gas. In this embodiment, intake 620 is located below the rest of the pumping system, although it is possible that one or more pumps or electrical motors can be located below the intakes. Intake 620 has diameter D, which is smaller than the diameter D' of electrical motor 602 (and, as shown, pump 611) which is immediately above intake 620.

Electrical motor 609 includes hollow rotor shaft 603. In the preferred embodiment shown, motor 602 includes a drive system including magnets 604 located about hollow rotor shaft 603 and stators 605 which are located on the interior of housing 610. When operated, hollow rotor shaft 603 rotates about its longitudinal axis. Hollow rotor shaft 603 is in fluid communication with intake 620. In the embodiment shown, motor 602 is directly above intake 620, and hollow rotor shaft 603 communicates directly with intake 620. However, one or more pumps can be located between motor 602 and intake 620, provided that hollow rotor shaft 603 is in fluid communication with intake 620 indirectly through the intervening pump.

In operation, a mixture of gaseous and liquid fluids enters the well through perforations 615. These move upwardly in the direction indicated by arrows 606 into vortex zones indicated in FIG. 6 by reference numerals 622. Vortex zones 622 are created in part by virtue of the diameter of intake 620 being smaller than that of electrical motor 602. In vortex zones 622, liquids and gasses separate efficiently. Gasses move upwardly in the direction indicated by arrows 608 between casing 602 and the exterior housings 610 and 609 of electrical motor 602 and pump 611. Liquids enter intake 620, flow downwardly through a section of intake 620, then enter hollow rotor shaft 603, and then are pumped upwardly to the wellhead. Arrows 607 in FIG. 6 indicate the direction of the liquids.

This last aspect of the invention is readily combined with, for example, the fifth aspect of the invention, so as to obtain the combined benefits of both.

In any of the embodiments of the invention, the pumping system may contain additional elements as may be necessary or desirable in any particular application. For example, seal chamber sections are often provided in pumping systems for deep hole wells. Such seal sections may also carry pump thrust and can perform additional functions as well, as described by Brookbank in "Inverted Pump Systems Design and Applications", ESP Workshop, Houston, Apr. 26-28, 2000. As described by Brookbank, the functions performed by the seal chamber section can be divided among several pieces of apparatus if desired. In this invention, a seal chamber section or other device for carrying pump thrust is preferably part of the pumping system. In so-called "inverted" embodiments, it is preferred that some means of carrying pump thrust is included in the pump or motor design or as a separate piece of apparatus above or below the pump. If desired, seal sections may be located above the pumping system, or between the motor and the pump. Any apparatus situated between the motor and pump must be adapted so that motive force is transmitted through the apparatus from the motor to the pump, and so that production fluids travel through the hollow rotor shaft in the motor, as described above.

Similarly, apparatus such as sand skirts, packers, various types of connectors and the like can be incorporated into the pumping system or used in conjunction with the pumping system. The pumping system may contain anti-cavitation devices like a primer pump to prevent cavitation of the fluid in the hollow rotor shaft or pump. These may be especially useful in configurations where the pump is above the motor.

In producing deep bore wells, it is common practice to use a pumping system that is made up of separate components of a relatively short length. This approach can be adopted in the process of this invention as well. The motor, pump, intakes, seal sections and other apparatus may be constructed as two or more separate sections that are connected together to form the overall pumping system.

A wide variety of electrical motor designs can be used in the pumping system of the invention, provided that the motor contains a hollow rotor shaft through which the production fluids can flow to provide cooling and/or vortex generators in the annulus between the motor and the well casing or shroud. Induction motors and brushless DC motors are useful, among others. Suitable motors of that type are described in U.S. Pat. Nos. 5,951,262 and 6,000,915, both to Hartman, both incorporated herein by reference in their entirety. No special motor design is required, except that (1) it is adapted for submergible applications, (2) it contains the hollow rotor shaft as described herein and (3) it is of a size and shape to fit within the well casing and allow production fluids to pass in fluid contact with the exterior of the motor. Conventional electric motors as are commonly used for downhole pumping applications can be used, if they are adapted to provide them with a hollow rotor shaft through which the production fluids can be pumped. In its simplest case, the motor can be any submergible electric motor having a longitudinal, rotating rotor shaft, in which the rotor shaft has a longitudinal bore. Conventional electric motors having a longitudinal rotor shaft in some cases can be retrofitted for use in this invention simply by boring out the rotor shaft to form the hollow rotor shaft.

The motor may be a single piece or a tandem configuration. Multiple motors can be used and, if desired, pumps can be placed both above and below the motor. Seal sections and other components may be installed between the motor and pump.

As the motor will be submerged in the production fluids, it is preferably adapted to operate in those conditions. The motor preferably will contain a motor fluid that provides lubrication but more importantly retards the entrainment of production fluids in the motor. The motor fluid may also contain various well-treating materials such as scale inhibitors, emulsifiers, anti-emulsion agents, surfactants, water, and the like. Various types of seals can be incorporated into the motor to retard the leakage of production fluids into it, and as mentioned above, seal chamber sections can be used to accommodate thermal expansion of the motor fluid and help equalize pressure between the inside and outside of the motor.

In a preferred type of motor, the motor fluid is at a positive pressure relative to the hollow rotor shaft of the motor and has leaking seals, so that motor fluid slowly leaks from the motor into the production fluid. A source of fresh motor fluid is provided, either from a reservoir in the pumping system or through a tube or capillary system from the wellhead. By maintaining a positive motor fluid pressure, displacement of the motor fluid by the production fluids can be reduced or eliminated, and motor life can be prolonged. A pressure independent modulating flow control valve, such as a Sko-Flo™ or SubSea™ valve is suitable for maintaining a suitable positive pressure and flow of fresh lubrication fluid into the motor.

A particularly preferred motor has vortex generators on its exterior surface, or else is enclosed within a shroud that has vortex generators on its interior surface. The vortex generators operate to generate streamwise vortices in the production fluids as they pass the exterior of the motor. The vortex generators are preferably static devices having geometry and dimensions such that when the production fluids flow through and past the generators, a swirl in the flow is imparted. These streamwise vortices greatly improve heat transfer from the exterior of the motor to the production fluids, even further increasing the benefits of this invention.

Figure 3:
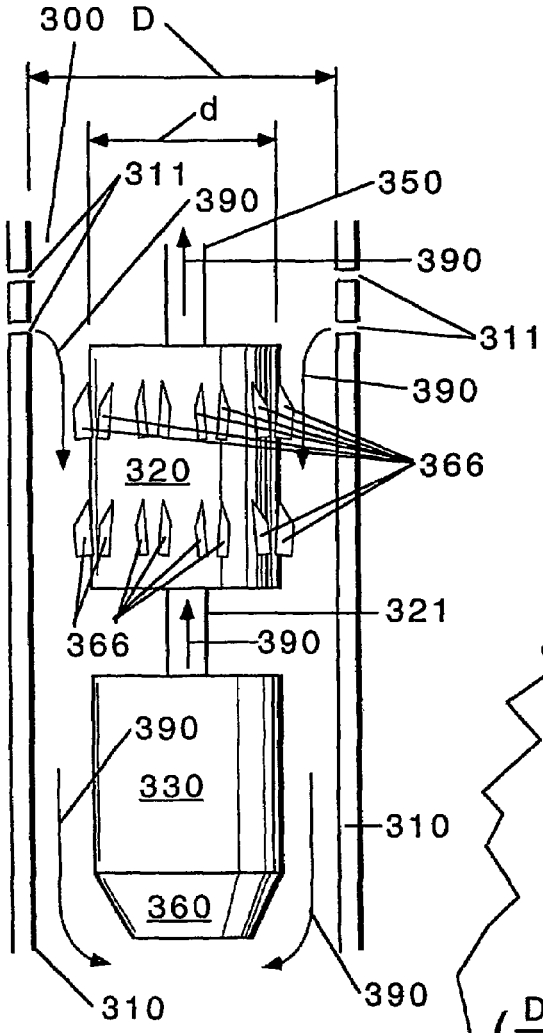
FIGS. 3 and 3A represent a schematic view and detail of an embodiment of a motor having vortex generators for use in preferred aspects of the invention.

An example of a motor containing vortex generators is schematically illustrated in FIG. 3. Well 300 has casing 310 and perforations 311. The internal diameter of well 300 is D. Motor 320 and pump 330, each having a diameter d, are disposed in the well. Motor 320 is affixed to production pipe 350, which extends to the wellhead. Hollow rotor shaft 321 connects motor 320 and pump 330, in the same manner as described with respect to FIG. 2. Pump 330 includes intake 360, where production fluids enter the pumping system. In the embodiment shown, production fluids enter the well at perforations 311, flow past the exterior of motor 320, into intake 360, through pump 330, through hollow rotor shaft 321 in motor 320 and up through production pipe 350 to the well head, as indicated by arrows 390.

In the embodiment shown in FIG. 3, the exterior surface of motor 320 has vortex generators. An alternative arrangement would be to surround motor 320 in a shroud that has vortex generators on its interior surface. In the embodiment in FIGS. 3 and 3A, the vortex generators take the form of a plurality of fins 366. Fins 366 are slightly offset to the direction of flow of the production fluids, and adjacent fins 366 are offset in opposite directions. Thus, each pair of fins 366 define a gap which narrows in the direction of flow. The dimensions of fins 366 and the offset angle are sufficient to create streamwise vortices in the production fluids as they flow past the fins.

Figure 3A:
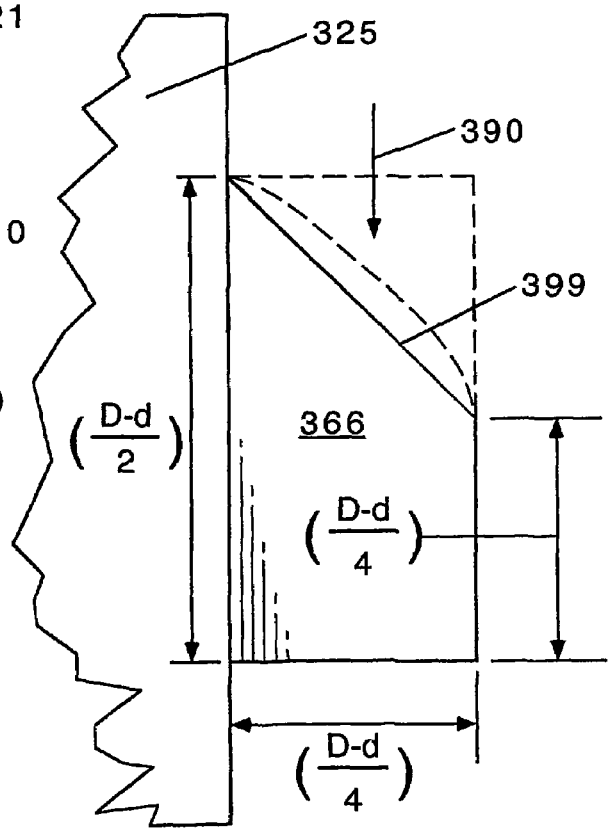

Suitable offset angles are typically +/−10-30, preferably 10-20 degrees from the direction of flow of the production fluids. Suitable dimensions for fins 366 are illustrated in FIG. 3A. In FIG. 3A, the gap between motor 320 and well casing 311 is defined by (D-d)/2, where D and d are as described above. A suitable fin 366 will extend outwardly from the exterior of motor 320 (or inwardly from the exterior surface of a surrounding shroud) approximately ⅓-¾ of the width of the gap between the motor and well casing or, when a shroud is used, between the motor and interior surface of the shroud; in FIG. 3A an especially preferred dimension of ½ the gap width is illustrated. In FIG. 3A, numeral 325 designates either the exterior surface of the motor or the internal surface of a surrounding shroud. As shown in FIG. 3A, fin 366 is preferably beveled with increasing width in the direction of flow, reaching its maximum width at a point approximately ⅓-¾ down its length. However, if desired, leading edge 399 can take other shapes, including those shown in outline in FIG. 3A. Overall length is preferably about 1 to about 4, more preferably about 1.5 to about 3 times the width of the gap. In FIG. 3A, the length is shown as equal to the gap width.

In the embodiment shown in FIG. 3, two rows of fins 366 are used. A single row can be used, or greater than two rows can be used. When multiple rows are used, a preferred spacing between the rows is about 10-30 times the gap distance. However, the spacing may be adjusted to trade off pressure loss with heat transfer.

Other suitable vortex generator designs can be used, such as are described, for example, by Paulie and Eaton, Report #MD51, August 1988, "The Fluid Dynamics and Heat Transfer Effect of Streamwise Vortices Embedded in a Turbulent Boundary Layer".

The pump itself has no special design requirements, other than it is adapted to pump production fluids through the hollow rotor shaft of the motor. Generally, the particulars of the pump design will be selected to fit the particular application. The pump is in liquid communication with the hollow rotor shaft of the motor. This is accomplished by building the pump and motor as a single unit or incorporating the pump into the motor, as described in U.S. Pat. Nos. 5,951,262 and 6,000,915, by designing the pump to mate with the hollow rotor shaft of the motor, or in some other manner. Pumps of the type conventionally used in ESPs are entirely suitable, and can easily be adapted for use in this invention through the design of the connection between the pump outlet (or inlet) and the motor. Progressive cavity pumps are also preferred types. The pump may be one piece or in tandem sections. Multiple pumps may be used. If desired, separate pumps can be provided above and below the motor.

The method of this invention is useful in a variety of wells, including water, oil and natural gas wells. The pumping method is particularly advantageous in wells where, using a conventional ESP, any flow of production fluids through the annulus between the motor housing and the well casing would be expected to be laminar. Wells of this type include those having well conditions such as high viscosity production fluids, the formation of emulsions, low flow rates, multiphase flows, deviated and horizontal wells and large motor and/or well diameters, especially in the oil industry. The well operator can take advantage of the enhanced heat transfer and improved cooling of the motor in several ways. At equivalent power usage, the motor will be more efficiently cooled, and the operating temperature will be lower. The operator may choose to take advantage of this lower operating temperature to prolong the motor life. The lower temperature also tends to reduce electrical resistance, thus allowing equivalent work to be done with less power consumption. Conversely, the operator may elect to increase the power to the motor so that it runs at higher temperatures similar to those that would be experienced in prior art processes. In this case, the operator chooses to forego longer motor life in return for higher production rates that are achieved because of the additional power that is used.

In order to increase cooling efficiency as the production fluids flow through hollow rotor shaft of the motor, it is preferred to operate under conditions that produce turbulent flow within the hollow rotor shaft. More preferably, there is turbulent flow both inside the hollow motor shaft, and turbulent flow or streamwise vortices in the annulus between the motor housing and the well casing where the production fluid passes in contact with the exterior of the motor. Turbulent flow can be expressed in terms of Reynolds number (a dimensionless parameter), which is a function of the average fluid velocity, kinematic viscosity of the fluid and diameter of the hollow rotor shaft. A Reynolds number of about 2300 or higher is typically indicative of turbulent flow. Preferably, flow conditions of the production fluids through the hollow rotor shaft of the motor is such that the Reynolds number is at least about 3000. A Reynolds number in excess of 5000 to 10000 is more preferred.

Another parameter, Nusselt number, is a dimensionless measure of heat transfer. The Nusselt number is a function of the Reynolds number, the Prantl number, and the absolute viscosity of the bulk fluid and fluid at the wall. With turbulent flow, a high Nusselt number (exceeding 10) represents a high heat transfer rate for a given temperature difference. The more turbulent the flow the higher the Reynolds and the Nusselt numbers. With laminar flow, low Nusselt numbers (below 5) are indicative of poor convective heat transfer. Enhanced heat transfer from the motor to the production fluid can be expected when the Nusselt number is at least 10, preferably at least 50, and the method of the invention is preferably operated under conditions that achieve such Nusselt numbers.

Operating conditions preferably are also chosen so as to provide a Brinkmann number (another dimensionless parameter) of less than 2, preferably less than 0.5. The Brinkmann number indicates the direction of heat transfer within a viscous fluid. It is a function of the average velocity of the fluid, its absolute viscosity, the thermal conductivity of the fluid and the temperature difference between the fluid and the inside wall of the hollow rotor shaft. When conditions are such that the Brinkmann number is less than 2, heat will travel from the hot motor to the cooler production fluid and fluid friction will not add additional heat to the motor.

Viscous dissipation effects are negligible, when the Brinkmann number is less than 0.5.

Since the hollow rotor shaft is the drive shaft of the motor, operating conditions can be further described with reference to a Rossby number (still another dimensionless parameter). The Rossby number provides an indication as to whether spinning flow will or will not dominate axial flow in the hollow rotor shaft. Conditions generating a Rossby number of at least about 0.5, preferably at least about 1.0 are preferred. The Rossby number is a function of average fluid velocity, fluid angular velocity and the inside diameter of the hollow rotor shaft.

Yet another advantage of this invention is that it permits gaseous production fluids to separate from liquids before entering the pumping system. Gasses entering the well through perforations above the pumping system will tend to travel directly upward to the wellhead without passing through the pumping system, due to the natural buoyancy of the gasses. Liquids will flow downwardly and enter the pumping system, without significant entrained gas, for delivery to the wellhead. Thus, a ready separation of production gasses and production liquids is made. Because the pumping system will process less gas, pumping problems and inefficiencies associated with pumping mixtures of gasses and liquids are largely mitigated. Moreover, by eliminating the need for oversized equipment or a gas separator in a typical system installed above the perforations, no additional failure modes or power losses are introduced.

The invention claimed is:

1. A method for producing fluids from a well having a casing that contains perforations through which production fluids enter the well, comprising (a) positioning an electrical submergible pumping system including an electric motor within said casing such that the electric motor is at or below at least some of said perforations, and (b) pumping production fluids from the well with said pumping system, wherein (1) the pumping system includes a pump, an electrical motor having a hollow rotor shaft and production fluid intakes located below said electrical motor, said pumping system being adapted to pump said production fluids through said hollow rotor shaft of the electrical motor, (2) production fluids entering the well through at least some of the perforations in the casing pass in fluid contact with exterior portions of the electrical motor and remove heat therefrom before entering the production fluid intakes, and (3) production fluids pass through the hollow rotor shaft of the electrical motor as the fluid travels to the wellhead, and remove additional heat from the motor.

2. The method of claim 1 wherein the production fluids pass though the hollow rotor shaft of the electrical motor under conditions of turbulent flow.

3. The method of claim 2 wherein the electrical motor is located between the wellhead and the pump.

4. The method of claim 3 wherein production fluids entering the well through the perforations in the casing travel downward in fluid contact with exterior portions of the electrical motor to an intake, and the liquid production fluids are subsequently pumped upwardly through the hollow rotor shaft of the electrical motor and then to the wellhead.

5. The method of claim 4, wherein the flow of production fluid through the hollow rotor shaft is characterized by a Reynolds number of at least 2300.

6. The method of claim 5 wherein the motor contains a motor fluid at a positive pressure to the exterior of the motor, and has seals which allow motor fluid to leak into the production fluid.

7. The method of claim 5, wherein conditions are selected such that heat transfer from at least one of the hollow rotor shaft and the exterior surfaces of the motor to the production fluid is characterized by a Nusselt number of at least 10.

8. The method of claim 5 wherein conditions are selected so as to generate a Brinkmann number of less than 2.

9. The method of claim 5 wherein conditions are selected so as to generate a Rossby number of more than 0.5.

10. The method of claim 2 wherein the pump is located between the wellhead and the electric motor.

11. The method of claim 2 wherein the electrical submergible pumping system contains two pumps, one of which is located above the electric motor and one of which is located below the electric motor.

12. A method comprising pumping a fluid with a submergible pumping system including a pump and an electrical motor, wherein the electrical motor has a hollow rotor shaft and said pumping system is adapted to pump at least a portion of said fluid through said hollow rotor shaft, and wherein during operation at least a portion of said fluid passes in fluid contact with exterior portions of the electrical motor and removes heat therefrom wherein (a) the electrical motor has a hollow rotor shaft and the pumping system has a fluid intake below the electrical motor and in liquid communication with said hollow rotor shaft;

(b) the pumping system has at least one outlet located at or below the electrical motor, said outlet being in liquid communication with the fluid intake, (c) the pumping system is submerged in a well having a well casing;

(d) the cross-section that the electrical motor is such that the electrical motor fits within the well casing and a space is defined between the well casing and the electrical motor; and (e) said pumping system is adapted so that during operation a portion of the fluid entering the fluid intake is pumped though the hollow rotor shaft of the electrical motor, and a portion of the fluid entering the fluid intake is pumped through the outlet and upwardly in fluid contact with the outside of the electrical motor.

13. A method of pumping fluids, comprising (I) positioning a pumping system in a well with the pump being located between the electrical motor and the wellhead; wherein (a) electrical motor has a hollow rotor shaft which is in liquid communication with the pump, (a) the cross-section of the electrical motor is such that the electrical motor fits within the well casing and a space is defined between the well casing and the electrical motor;

(b) the pumping system has a first fluid intake in liquid communication with said hollow rotor shaft;

(c) the pumping system has a second fluid intake above the motor in liquid communication with the space defined between the well casing and the electrical motor, with the at least one outlet located at or below the electrical motor, said outlet being in liquid communication with the fluid intake; and (II) operating said pumping system under conditions such that during operation a portion of the fluids enter said first fluid intake and is pumped through the hollow rotor shaft of the electrical motor, and a second portion of the fluids are pumped through the space defined between the well casing and the electrical motor and in fluid contact with the exterior of the electrical motor to enter the second fluid intake, and said first and second portions of the fluids are then pumped to the wellhead.

14. A mechanism for providing motive force, the mechanism comprising (I) a power unit including:

(a) a housing having an exterior wall;

(b) a hollow rotor shaft having a longitudinal axis and opposite ends, the hollow rotor shaft being rotatably mounted within the housing for rotation of the hollow rotor shaft relative to the housing, substantially about the longitudinal axis of the hollow rotor shaft; and (c) a drive system mounted within said housing connected to the hollow rotor shaft for causing rotation of the hollow rotor shaft relative to the housing, wherein the drive system includes a plurality of magnets mounted within the housing, located around the hollow rotor shaft, wherein the magnets create magnetic forces for causing the hollow rotor shaft to rotate relative to the housing;

and (II) a pumping unit located below the power unit, wherein (i) the pumping unit includes a longitudinal hollow drive shaft that is in fluid communication with the hollow rotor shaft in the power unit, the hollow drive shaft being rotated substantially about its longitudinal axis when the hollow rotor shaft of the power unit is rotated;

(ii) the hollow drive shaft of the pumping unit has a shaft inlet proximate to its bottom, portion for allowing fluids being pumped to enter the hollow drive shaft;

(iii) at least one impeller mounted to the exterior of the hollow drive shaft of the pumping unit such that when the hollow drive shaft is rotated, the impeller pumps fluids downwardly toward the inlet in the hollow drive shaft; and (iv) the pumping unit has fluid intakes proximate to a topmost portion thereof through which fluids being pumped enter the pumping unit; the fluid intakes, hollow drive shaft, shaft inlet and impellers being adapted such that when the hollow drive shaft is rotated about its longitudinal axis, fluids are pumped into the pumping unit through said fluid intakes, downwardly within the pumping unit to the shaft inlet, and then through the hollow drive shaft of the pumping unit and through the hollow rotor shaft of the power unit.

15. A method of removing a mixture of gaseous and liquid fluids from a well having at least one point where a mixture of gaseous and liquid fluids enter the well, comprising (I) positioning a pumping system in the well above the point or points where the mixture of gaseous and liquid fluids enter the well, wherein:

(a) the pumping system includes at least one power unit, at least one pumping unit, and at least one intake through which fluids being pumped enter the pumping system;

(b) the power unit includes a hollow rotor shaft in fluid communication said intake, and the pumping system is adapted such that fluids entering the intake are pumped through the hollow rotor shaft of the motor;

(c) the power unit and pumping unit are smaller in diameter than the well;

(d) the intake is located below at least a portion of the pumping system and is of smaller diameter than at least that portion of the pumping system above the intake;

(e) the intake is adapted such that liquid fluids being pumped by the pumping system are caused to flow downwardly through a section of the intake to enter the pumping system; and (II) operating the pumping system such that (i) the gaseous fluids and the liquid fluids separate at a point proximate to the intake and below that portion of the pumping system above the intake, (ii) the gaseous fluids bypass the pumping system and rise to the surface of the well, and (iii) the liquid fluids being pumped flow upwardly to the intake, then downwardly through a section of the intake and then through the hollow rotor shaft of the motor and out of the well.

16. A method of pumping fluids with a submergible pumping system including a pump and an electrical motor, wherein the pumping system is submerged in production fluids such that said fluids flow across vortex generators adapted to impart streamwise vorticity to the production fluids as they pass in fluid contact with the exterior portions of the electrical motor wherein the vortex generators are attached to the exterior portions of the electric motor.

17. A method of pumping fluids with a submergible pumping system including a pump and an electrical motor, wherein the pumping system is submerged in production fluids such that said fluids flow across vortex generators adapted to impart streamwise vorticity to the production fluids as they pass in fluid contact with the exterior portions of the electrical motor wherein the vortex generators are attached to the interior surface of a motor shroud.

* * * * *